United States Patent [19]

Ungar et al.

[11] Patent Number: 4,587,659

[45] Date of Patent: May 6, 1986

[54] FEED THROUGH STRUCTURE FOR ELECTRODES IN ELECTRIC FURNACES

[75] Inventors: Karl-Heinz Ungar, Mülheim; Hermann Cepin, Duisburg, both of Fed. Rep. of Germany

[73] Assignee: Mannesmann Aktiengesellschaft, Duesseldorf, Fed. Rep. of Germany

[21] Appl. No.: 684,674

[22] Filed: Dec. 21, 1984

[30] Foreign Application Priority Data

Jan. 2, 1984 [DE] Fed. Rep. of Germany ..... 3400186

[51] Int. Cl.[4] ..... H05B 7/10

[52] U.S. Cl. ..... 373/96; 373/69

[58] Field of Search ..... 373/71, 73, 74, 94, 373/95, 96, 101

[56] References Cited

U.S. PATENT DOCUMENTS 4,425,656 1/1984 Kuhlmann ..... 373/74

4,445,220 4/1984 Kuhlmann ..... 373/74

FOREIGN PATENT DOCUMENTS 1100310 1/1968 United Kingdom ..... 373/95

*Primary Examiner*—Roy N. Envall, Jr.

*Attorney, Agent, or Firm*—Ralf H. Siegemund

[57] ABSTRACT

A feed through structure for passing electrodes through a furnace cover into the interior of an electro furnace such as an electric arc or reduction furnace includes thin walled, water cooled hollow cylinders made of electrically conductive material and being provided in apertures in the cover; electrodes are passed through cylinders and electrically conductive hollow copper bridges interconnect all of said hollow cylinders to the extent they pertain to different phases; these bridges are provided in pairs for separately connecting the inside and outside ends of the hollowed cylinders.

5 Claims, 4 Drawing Figures

(B-B)

(A-A)

FEED THROUGH STRUCTURE FOR ELECTRODES IN ELECTRIC FURNACES

BACKGROUND OF THE INVENTION

The present invention relates to the feed through of electrodes, through the cover of a electric arc or reduction furnace, and more particularly the invention relates to a device for running an electrode through a twin wall, water cooled hollow cylinder made of electrically conductive material which circumscribes the electrode as well as current conductors and contact brackets which may be arranged axis-parallelly around the electrode in the case of deep or dropped sockets.

German Pat. No. 2,125,773 describes structure for running electrodes through the cover of an arc furnace or of a reduction furnace under utilization of water cooled cooling jacket arranged respectively around each electrode in axis-parallel relationship. Each of these cooling jackets is provided with a fitting of an annular configuration to receive extension sleeves for pressing the contact brackets against the electrodes. Such an arrangement is disposed underneath the cover. Parts for conducting electric current to the electrodes are arranged in the immediate vicinity of the furnace and usually they are encapsulated in a cooling jacket in order to be protected against the heat of the furnace as well as against any chemically agressive gases. It was found, however, that this encapsulation does not avoid all detrimental effects which may interfere with the operation of the furnace. For example the electric current induced in the hollow cylinder forms a magnetic field which is effective in its vicinity in one way or another. The electric current of and in the hollow cylinder induces in turn an electric current in the furnace cover. This in turn entails undue inductive heating of the cover. Another disadvantage is the lossless resistance of an inductive nature, which is increased in such a manner, and entails a higher power rating, particularly for the furnace transformer as well as for the high current conductor running current to the furnace.

DESCRIPTION OF THE INVENTION

It is an object of the present invention to avoid the problems outlined above and to provide structure for running electrodes through the cover of an electric arc or reduction furnace, such that the inductive lossless resistance of the electrodes passed through is reduced, so that in turn the power factor for AC transformation is increased, while simultaneously undesired inductive heating is avoided.

It is a particular object of the present invention to provide a new and improved feed through structure for electrodes, to run these electrodes through the cover of an electric arc or reduction furnace which structure includes, for each electrode, a twin wall, water cooled hollow cylinder, made of electrically conducted material, circumscribing the electrodes and, possibly, current conductors and contact brackets in axis parallel relationship and as coaxially circumscribing the electrodes.

In accordance with the preferred embodiment of the present invention, it is suggested to provide an electrode feed through structure as per the particular object of the present invention, and that the axial ends of the hollow cylinders, extenting in the same plane, are electrically interconnected by electrically conductive bridges and for all phases of the AC current that is being supplied to these electrodes.

In furtherance of the invention is is suggested to provide coolant ducts in these bridges which are preferably made of copper. In a preferred form it is further suggested that the bridges facing the furnace interior and being connected to the respective hollow cylinders, are run for a small distance parallel to the outer jacket, through the furnace, and along that side of the cover facing away from the furnace. Planar elements are arranged on the inside of the hollow cylinder extending over the entire length thereof, which planar elements circumscribe partially the current feed bars in case of bulky cross section. These latter planar surface elements are preferably ribbs arranged at a spacing between the current feed conductors.

It can thus be seen that in accordance with the invention the electrodes as such, and in a case of a depressed fitting also the current feed through conductors being arranged around the electrodes, are circumscribed in the area of passage or feed through the furnace cover by respective, associated, hollow cylinders. As the electric current runs through the high current feed conductor and the electrodes, a current is induced in the hollow cylinder. The cylinder is configured as an encapsulation element, so that the induced current has a direction opposite to the current flowing through the respective electrode in any instant. This way the magnetic field tend to compensate each other leading to an attenuation of the tendency of the resulting magnetic field to induce current in the cover.

The inner jacket of the hollow cylinder is preferably constructed in form of niches formed through ribs, which enhance the formation of current conduction in the hollow cylinder. It is very important that the hollow cylinders pertaining to each phase are interconnected by bridges. This way the hollowed cylinders become current conductors of particular relation to the coaxially run through elements such as the electrodes and the current feed through devices, and establish in fact a transformer type secondary circuit. The resulting current in the encapsulating hollow cylinder flow is stated, in direction opposite to the respective current direction through the respective electrodes and that in turns means that any magnetic field appearing outside of the encapsulation is almost completely compensated. This feature avoids losses into the environment and parasitic current development as between the several phases. The hollow cylinders are, moreover, configured in a manner known per se as cooling jackets for purposes of protecting the electrodes and in some cases for protecting also the current fed through conductors if they are provided. In the case of electrode furnaces with depressed fitting for current feed the hollow cylinders receive tension sleeves which provide the requisite contact pressure by means of which contact brackets are urged against the electrodes.

DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

Proceeding now to the detailed description of the drawings, FIG. 1 illustrates schematically a plurality of 3 hollow cylinders 4, through which electrodes are run through, respectively for phases R, S and T of a three phase electric current system. These cylinders are interconnected through bridges 6 and 6'. There are accordingly six such bridges, three upper ones (6) and three lower ones (6'), and each bridge interconnects two of the hollow cylinders. Specifically, the upper bars 6 interconnect the upper (outer) ends of the feed through cylinders and the lower bars 6' interconnect the lower (inner or interior) ends of the cylinders.

It can thus be seen that all three phases for the electrode feed through are interconnected through such bridges. In the case of electro furnaces with a larger number of electrodes, the rule still prevails that all phases of respective furnace transformers are to be interconnected by such bridges in an analogous fashion.

Figure 2:
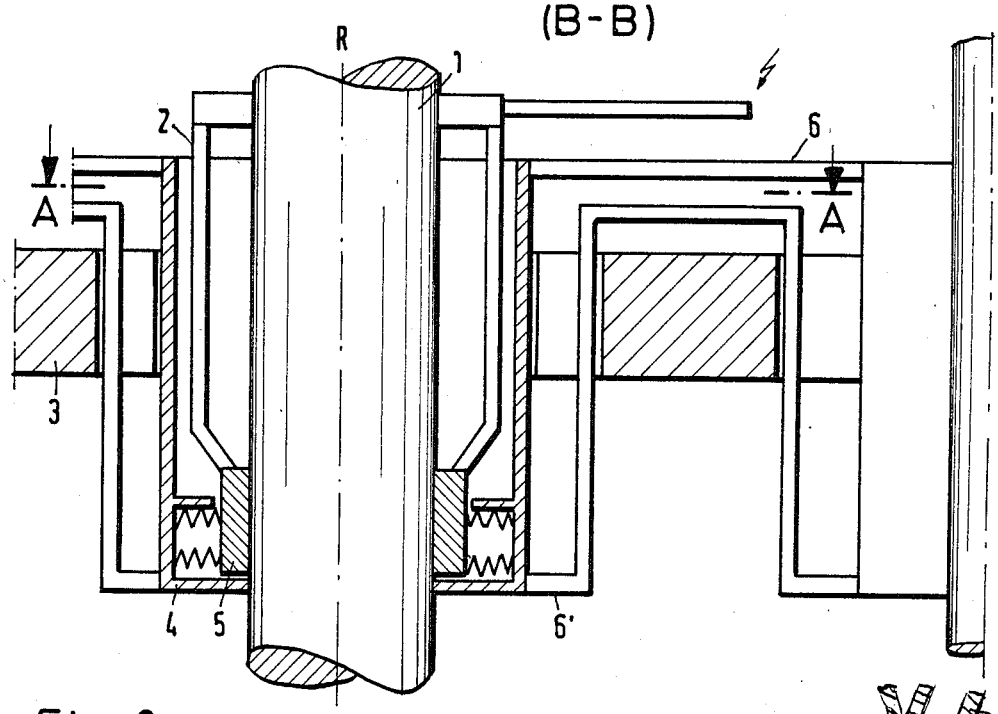
FIG. 2 is a vertical section view through a hollow cylinder and adjoining parts for an electrode feed through arrangement in an electric arc or reduction furnace and in accordance with the preferred embodiment of the present invention for practicing the best mode thereof.
Figure 3:
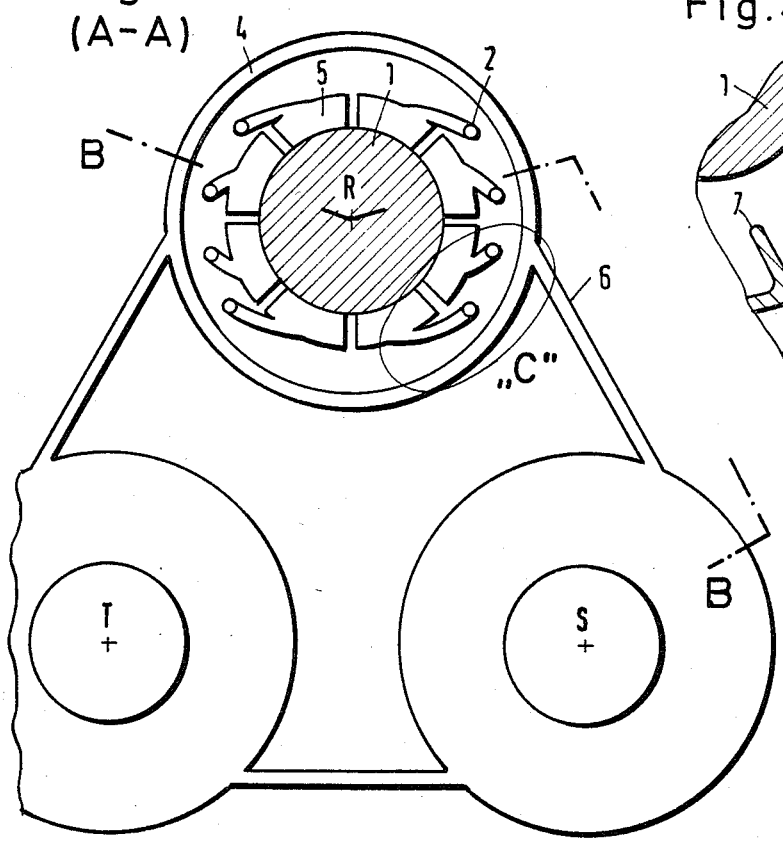
FIG. 3 is a section view taken in the plane A A in FIG. 2, showing moreover section lines B B which is the section view taken for FIG. 2.

After having described certain aspects in principle, reference is made to the detailed construction of electrode feed through as illustrated in FIGS. 2 and 3. By way of representative example in FIG. 2, there is an electrode 1, for example for the phase R, being circumscribed in part by current feeders 2 ending in contact brackets 5, which are urged against the electrodes, such as electrode 1. A device for urging such brackets against an electrode is shown in detail, for example, in copending application Ser. No. 668,037 filed Nov. 5, 1984 of common assignee.

The electrode 1, the current feed through structure 2, as well as the contact brackets are all contained within a hollow cylinder, such as 4. For ease of representation the tubular device 4 is shown as a single element in FIG. 2, but the twinwall structure is depicted in detail in FIG. 4 showing inner jacket 4*a* and center jacket 4*b* of such a twinwall tube-cylinder 4.

Reference numeral 3 refers to the furnace cover and hollow cylinder 4 is arranged perpendicular to the planar extension of that cover. It can readily be seen that the lower portion, as per FIG. 2, of the hollow cylinder 4 and connected parts face the interior of the furnace, while the upper portion in FIG. 2 represents the outside.

Figure 1:
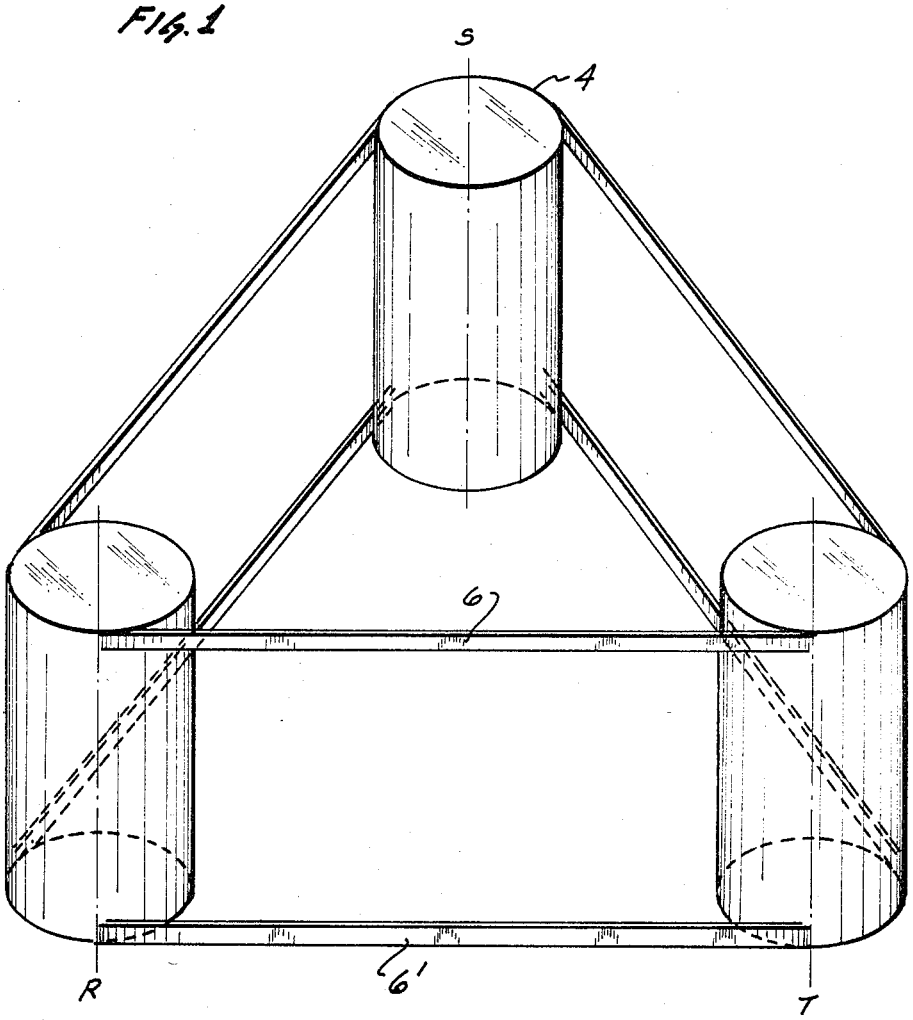
FIG. 1 is a schematic showing of the electric encapsulating cylinders for feeding electrodes through the cover of an electric furnace.

FIG. 1 showed the interconnection of hollow cylinders on a schematic basis, but the conduct bridges 6 and 6' are shown in FIGS. 2 and 3 in a configuration which represents there true design. Electrically these bridges run in parallel, but physically they are constructed differently, as can be seen by comparing bridge 6 with 6' for example in FIG. 2. The outside bridges 6 run from upper cylinder end to upper cylinder end above the cover 3. The inside bridges 6' in particular face the interior of the furnace and are connected particularly to the lower end of each of the cylinders 4. They do however run in part on the outside of the furnace, i.e. above the cover 3. For this, they run radially away from the respective lower cylinder end, up along the wall of outer jacket 4*b*, through the cover 3 and along its top until being run back into the furnace for connection to the lower cylinder end of an adjacent feed through structure.

Figure 4:
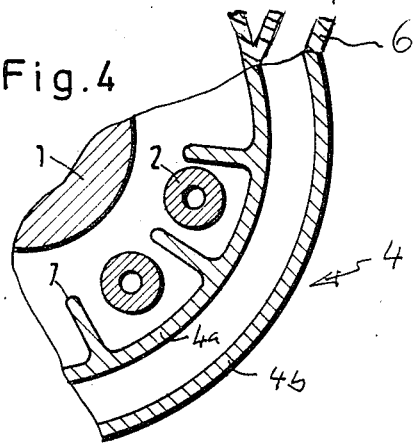
FIG. 4 illustrates a section view of a detail of a hollow cylinder in the area of current feed through, the detailed area being denoted -c- in FIG. 3.

FIG. 4 illustrates detail C as indicated in FIG. 3, particularly in the vicinity of the section A A as per FIG. 2. One can see that the twin wall hollow cylinder 4 (4*a*, 4*b*) is provided on its inside (4*a*) with radially inwardly extending ribs 7 extending otherwise in axial direction. These ribs have a radial depth which is roughly twice the diameter of the current feed through conductor 2 and are arranged between adjacent ones thereof. The section on the inside hollow cylinder 4*a*, in between two ribs and adjoining respective two ribs establish a niche which grips around in fact each of the current conductors 2 basically from three sides. FIG. 4 shows also that the bridges such as 6 being connected to the cylinder or tubes 4 are actually constructed as ducts, i.e. they are hollow to be passed through by the coolant.

The electric current runs through the high current feed conductor such as 2 and the respective electrode 1. As a consequence, a secondary current is induced in the hollow cylinder 4. Since the cylinder is an encapsulation element, the induced current flows in a direction opposite to the current flowing through the respective electrode in any instant. Each current produces a magnetic field but the electrode current and the induced current produce compensating magnetic fields so that the tendency of any resulting magnetic field to induce current in the cover 3 is reduced or avoided.

It is very important that the hollow cylinders 4 pertaining to the different phases are interconnected by the bridges 6 and 6'. This way the hollow cylinders 4 become current conductors of particular relation to the coaxially run through elements such as the electrodes and the current feed through devices, and establish in fact a transformer type secondary circuit. The resulting current in the encapsulating hollow cylinder flow as a stated, in direction opposite to the respective current direction through the respective electrodes and that in turn means that any magnetic field appearing outside of the encapsulation is almost completely compensated. This feature avoids losses into the environment and parasitic current development as between the several phases.

The invention is not limited to the embodiments described above, but all changes and modifications thereof, not constituting departures from the spirit and scope of the invention, are intended to be included.

We claim:

1. Feed through structure for electrodes for passing the electrodes through a furnace cover into the interior of an electro furnace such as an electric arc or reduction furnace, comprising;

a plurality of twin walled, water cooled hollow cylinders made of electrically conductive material, and provided in aperatures in said cover;

electrodes being passed through and received by said hollow cylinders; and electrically conductive bridges for interconnecting all of said hollow cylinders to the extent they pertain to different phases, said bridges being provided in pairs for connecting the inside ends of the hollowed cylinders as well as the outside ends of the hollow cylinders as far as interior of the furnace is concerned.

2. Structure as in claim 1, said bridges being made of copper.

3. Structure as in claim 1, said bridges include ducts for a coolant

4. Structure as in claim 1, wherein said bridges as connected to the inside ends of the hollow cylinders are run through the cover and along portions of the cover on the outside of the furnace.

5. Structure as in claim 1, said hollow cylinder having on its inside inwardly extending ribs, there being current feed through electrodes disposed in between the ribs.

* * * * *